US006305796B1

(12) United States Patent
Szlucha et al.

(10) Patent No.: US 6,305,796 B1
(45) Date of Patent: Oct. 23, 2001

(54) THERMAL INK JET PRINTER HAVING DUAL FUNCTION DRYER

(75) Inventors: Thomas F. Szlucha; Kenneth W. Altfather, both of Fairport; Donald M. Stevens, Walworth, all of NY (US); Michael Carlotta, Alpharetta, GA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/236,553

(22) Filed: Jan. 26, 1999

(51) Int. Cl.[7] ..... B41J 2/01
(52) U.S. Cl. ..... 347/102; 347/101; 347/100
(58) Field of Search ..... 347/102, 101, 347/100

(56) References Cited

U.S. PATENT DOCUMENTS

| | | | |
|---|---|---|---|
| 4,970,528 | 11/1990 | Beaufort et al. . | |
| 4,982,207 | 1/1991 | Tunmore et al. . | |
| 5,005,025 | 4/1991 | Miyakawa et al. . | |
| 5,029,311 | 7/1991 | Brandkamp et al. . | |
| 5,192,959 | 3/1993 | Drake et al. . | |
| 5,274,400 | 12/1993 | Johnson et al. . | |
| 5,287,123 | 2/1994 | Medin et al. . | |
| 5,406,321 | 4/1995 | Schwiebert et al. . | |
| 5,754,208 * | 5/1998 | Szlucha | 347/102 |

* cited by examiner

*Primary Examiner*—John Barlow
*Assistant Examiner*—Manish S. Shah
(74) *Attorney, Agent, or Firm*—Oliff & Berridge, PLC

(57) ABSTRACT

A printing machine for printing on a recording medium moving along a path through a print zone, includes a printhead, adapted to deposit ink on the recording medium in the print zone; and a radiant dryer, disposed adjacently to the path, for heating the recording medium. The radiant dryer includes a reflector and a heat source. The reflector includes a first portion defining a first heat region preheating the recording medium at a position in the path prior to the print zone, and a second portion defining a second heat region heating the recording medium in or subsequent to the print zone. In this design, the first portion generates heat energy having a first temperature and said second portion generates heat energy having a second temperature greater than said first temperature.

20 Claims, 4 Drawing Sheets

THERMAL INK JET PRINTER HAVING DUAL FUNCTION DRYER

BACKGROUND OF THE INVENTION

1. Field of Invention

This invention relates generally to a liquid ink printing apparatus, and more particularly to a liquid ink printing apparatus having a dual function radiant dryer.

2. Description of Related Art

Liquid ink printers of the type frequently referred to as continuous stream or as drop-on-demand, such as piezoelectric, acoustic, phase change wax-based or thermal printer, have at least one printhead from which droplets of ink are directed towards a recording medium. Within the printhead, the ink is contained in at least one channel, or preferably in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in one of the plurality of channels. As voltage is applied across a selected resistor, a vapor bubble grows in the associated channel and initially bulges from the channel orifice, followed by collapse of the bubble. The ink within the channel then retracts and separates from the bulging ink, to form a droplet moving in a direction away from the channel orifice and towards the recording medium. When the ink droplet hits the recording medium, a drop or spot of ink is deposited. The channel is then refilled by capillary action, which, in turn, draws ink from a supply container of liquid ink.

The ink jet printhead may be incorporated into either a carriage type printer, a partial-width-array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage, which is reciprocated to print one swath of information (having a width equal to the length of a column of nozzles) at a time on a stationary recording medium, such as paper or a transparency. After the swath is printed, the paper is stepped a distance equal to the height of the printed swath or a portion of the swath, so that the next printed swath is contiguous or overlapping with the previously printed swath. This procedure is repeated until the entire page is printed. In contrast, the page-width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks, and particularly those used in thermal ink jet printing, include a colorant or dye and a liquid, which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types, which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning the recording medium typically prepares the recording medium for receiving ink by driving out excess moisture, which can be present in a recording medium such as paper. Not only does this preconditioning step reduce the amount of time necessary to dry the ink once it is deposited on the recording medium, but this preconditioning step also improves image quality by reducing paper cockle and curl, which can result from too much moisture remaining in the recording medium.

Various drying mechanisms for drying images deposited on recording mediums are illustrated and described in the following disclosures, which may be relevant to certain aspects of this invention.

U.S. Pat. No. 4,970,528 to Beaufort et al., describes a method for uniformly drying ink on paper from an ink jet printer. The printer includes a uniform heat flux dryer system including a 180° contoured paper transport path for transferring paper from an input supply tray to an output tray. During transport, the paper receives a uniform heat flux from an infrared bulb located at the axis of symmetry of the paper transport path. Reflectors are positioned on each side of the infrared bulb to maximize heat transmission from the bulb to the paper during the ink drying process.

U.S. Pat. No. 5,029,311 to Brandkamp et al., describes a fluorescent lamp utilized in a document scanning system that is environmentally and thermally stabilized by means of a bifurcated heater control assembly. A heater blanket is wrapped around the entire surface of the lamp, including the end areas surrounding the filaments but exclusive of the aperture through which light is emitted.

U.S. Pat. No. 5,274,400 to Johnson et al. describes an ink path geometry for high temperature operation of ink jet printheads. A heating means is positioned close to a print zone for drying of the print medium. The heating means includes a print heater and a reflector, which serve to concentrate the heat on the bottom of the print medium through a screen.

U.S. Pat. No. 5,287,123 to Medin et al. describes a color ink jet printer having a heating blower system for evaporating ink carriers from the print medium after ink-jet printing. A print heater halogen quartz bulb heats the underside of the medium via radiant and convective heat transfer through an opening pattern formed in a print zone heater screen.

U.S. Pat. No. 4,982,207, to Tunmore et al. describes a heater construction for an ink jet printer having a rotary print platen for holding and transporting a print sheet through a print path. The platen heater includes a hollow shell having vacuum holes for sheet attachment. A heating foil is detachably mounted in a heat transfer relation with the interior periphery of the shell.

U.S. Pat. No. 5,005,025, to Miyakawa et al. describes an ink jet recording apparatus for recording, which fixes ink through evaporation of an ink solvent. The apparatus includes a heating member extending both upstream and downstream with respect to a recording area and a conveying direction of the recording sheet. The heating member contacts the recording sheet to assist in fixing the ink.

U.S. Pat. No. 5,406,321, to Schwiebert et al. describes an ink jet printer and a paper preconditioning preheater for the ink jet printer. The paper preconditioning preheater has a curved surface and a multi-purpose paper path component to accomplish direction reversal for the paper. The paper contacts the preheater, which dries and shrinks the paper to condition it for a printing operation. The preheater is a thin flexible film carrying heater elements that is suspended in air to provide extremely low thermal mass and eliminate the need for long warm up times.

SUMMARY OF THE INVENTION

Despite these various designs, a need exists for an ink jet printer dryer system that efficiently works to dry printed substrates. This need is particularly evident in the field of color ink jet printing, where one color printed area is preferably dried, either partially or completely, prior to printing with a second color. Such a system is required in order to minimize inter-color bleed, a problem that results when a subsequently printed color bleeds into a previously printed color, or vice-versa, causing a print image defect. That is, when two colors are printed in sequence, either on top of or adjacent to one another, the colors will unintentionally mix with each other if there is insufficient drying of the first printed color prior to printing the second color. This creates a gross deficiency in the print quality, affecting the sharpness of the edges and the overall resolution of the image. The problem of intercolor bleed can be dealt with by first printing one color and allowing time for this ink to penetrate the paper before printing the second color, but this limits the speed of the printing device. High speed ink jet printing devices utilize drying to control the intercolor bleed problem.

Current state-of-the-art printing systems typically utilize a multiple dryer mechanism, where, for example, one dryer is located in a preheat station and a second dryer is located in a primary drying station that is either within or subsequent to the printing zone. Such printing systems typically use a contact heater in the preheat station, to precondition (or predry) the paper prior to printing. As described above, such predrying is intended to improve latitude with respect to paper moisture and environment.

The predrying station removes excess moisture from the print substrate prior to the print substrate entering the print zone. Once in the print zone, the typical dryer configuration is the use of a radiant infra-red energy heat source that heats the paper through the back side of the paper while ink is being applied to the front side. Energy density in the order of 10 $W/in^2$ are supplied to the paper through the low color (infrared) temperature source, which typically is in the range of 1000–1300° K. Such a light source is used because water molecules have a strong affinity for infrared energy with a wavelength of 2.6 microns, which is abundant at this color temperature range.

However, a problem with such typical printer dryer designs is that the heat source causes the paper to dry very quickly. This in turn can cause instability and buckling in the print zone. This problem is further exacerbated in high moisture content papers. In such cases, the predrying station described above has been proposed as a solution. Such predrying stations generally have a much lower energy output, in the range of 2–3 $W/in^2$ with a dwell time of several seconds.

However, addition of such predrying stations to an ink jet printer pose economic and design problems. For example, the addition of the predrying station can be costly, requiring both separate heating elements and control components. This adds both to the manufacturing cost of the printer as well as to its operating and maintenance costs.

Furthermore, a need exists for printer dryer designs that will efficiently and quickly dry the printed image without causing image or paper defects. Such printer dryer designs will permit still higher increases in paper throughput speed, permitting higher speed printing.

This invention provides an active drying system that efficiently provides both primary and secondary (preheating) functions using a single component with a single control system, rather than by two different components having separate control systems.

The active drying system of this invention thus includes a dual function radiant dryer that can be incorporated into a printing apparatus, such as an ink jet printer, to provide higher printing efficiency, higher print quality, and lower cost.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Although the active dryer system discussed herein may be used for drying any image that is created by a liquid ink printer, the description of the active dryer system of this invention will be described in the environment of a liquid ink printer such as that shown in FIG. 1.

Figure 1:
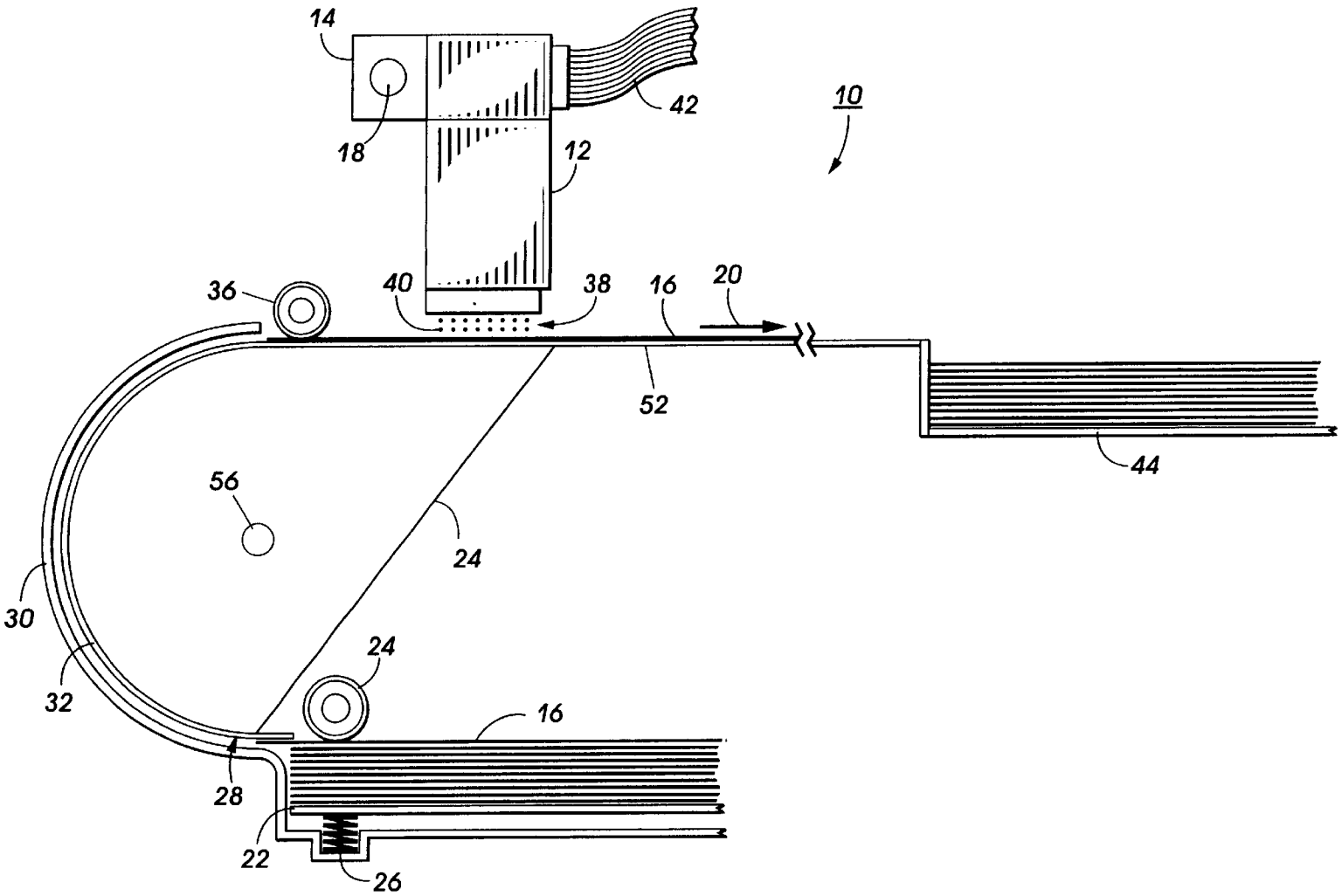
FIG. 1 illustrates an exemplary printer drying design according to the present invention.

FIG. 1 illustrates a schematic representation of a liquid ink printer 10 in a side elevation view. A translating ink jet printhead 12 printing black and/or colored inks is supported by a carriage 14, which moves back and forth across a recording medium 16, for instance, a sheet of paper or a transparency, on a guide rail 18. Multiple printheads (not shown) printing different colors, or a full-width printbar (not shown) printing one or more colors, could also be used in the liquid ink printer 10. The recording medium 16 moves along a recording medium path through the liquid ink printer 10 in the direction noted by the arrow 20. Single sheets of the recording medium 16 are fed from a supply tray 22 by a document feed roll 24. The document tray 22 is spring biased by a biasing mechanism 26, which forces the top sheet of the stack of recording sheets held by the tray 22 into contact with the feed roll 24. The topmost recording medium 16, in contact with the drive roll 24, is transported by the drive roll 24 into a chute 28, which is defined by an outer guide member 30 spaced from an inner guide member 32, each of which are curved to reverse the direction of the recording sheets 16 for printing by the printhead 12. Once the recording medium exits the chute 28, the recording medium 16 is driven by a drive roll 36 to advance the recording sheet 16 into a print zone 38.

The print zone 38 is the area directly beneath the printhead 12 where droplets of ink 40 are deposited by an array of ink nozzles printing a swath of information and arranged on a front face of the printhead 12. The front face of the printhead 12 is substantially parallel to the recording medium 16. The carriage 14, traveling orthogonally to the recording medium 16, deposits the ink droplets 40 upon the recording medium 16 in an imagewise fashion. The printhead 12 receives ink from either an attached ink tank or from an ink supply tube (not shown). The image deposited upon the recording medium 16 can include text and/or graphic images, the creation of which is controlled by a controller, known to those skilled in the art, in response to electrical signals traveling through a ribbon cable 42 coupled to the printhead 12. Before the recording medium 16 has completely left control of the drive roll 36, an exit drive roll/pinch roll combination (not shown), or other known means, captures the leading edge of the recording medium 16 for transport to an output tray 44, which holds printed recording medium.

To fix the liquid ink to the recording medium 16, the moisture must be driven from the ink and the recording medium 16. While it is possible to dry the ink by natural air drying, natural air drying can create certain problems such as cockle or curl and can also reduce the printing throughput of the liquid ink printer 10. Consequently, active drying by applying heat energy to the printed recording medium 16 is preferred. To improve printing quality, the active drying system of this invention includes a dual function radiant dryer 50, which is located along the inside of the inner guide member 32 from a position just after the supply tray 22 to a position just after the print zone 38. The dual function radiant dryer 50 generates heat energy using a heat source 56 located within the dryer 50. A portion of the heat generated by the heat source 56 is absorbed by the walls of the dryer 50, and is transferred to and through the inner guide member 32 to heat the recording medium 16. The dryer 50 is located within the liquid ink printer 10 such that the side of the recording medium 16 opposite the side to be printed receives the heat energy. Heat energy is delivered primarily through conduction. The inner guide section 32 can include apertures, such as round holes, diagonally placed slots, or raised areas to shorten warm-up times. Once the leading edge of the recording medium 16 has passed into the print zone 38, ink is deposited on the recording medium 16 in the print zone 38. During traversal through the print zone 38, the recording medium 16 is supported by a support platen 52 that defines a substantially planar surface. The support platen 52 can be in any of various combinations, as will be known to one skilled in the art, and can be, among other designs, an extension of the piece forming the inner guide member 32 or can be a material having apertures in the support platen 52 to provide more direct access to the dryer 50 located beneath the support platen 52. For example, a suitable structure of the support platen 52 having apertures is disclosed in U.S. Pat. No. 5,754,208, the entire disclosure of which is incorporated herein by reference. Alternatively, one or both of the inner guide member 32 and the support platen 52 can be omitted, and instead can be formed directly by the outer wall of the dryer 50.

Furthermore, although the above description is with reference to heating the recording medium from the back side in relation to the printing side, the present invention is not limited to such embodiments. Rather, the dual function radiant dryer of the present invention can, in embodiments, be readily modified to heat the recording medium from the printing side thereof, or secondary heaters on the printing side can be suitably combined with the dual function radiant heater.

Figure 2:
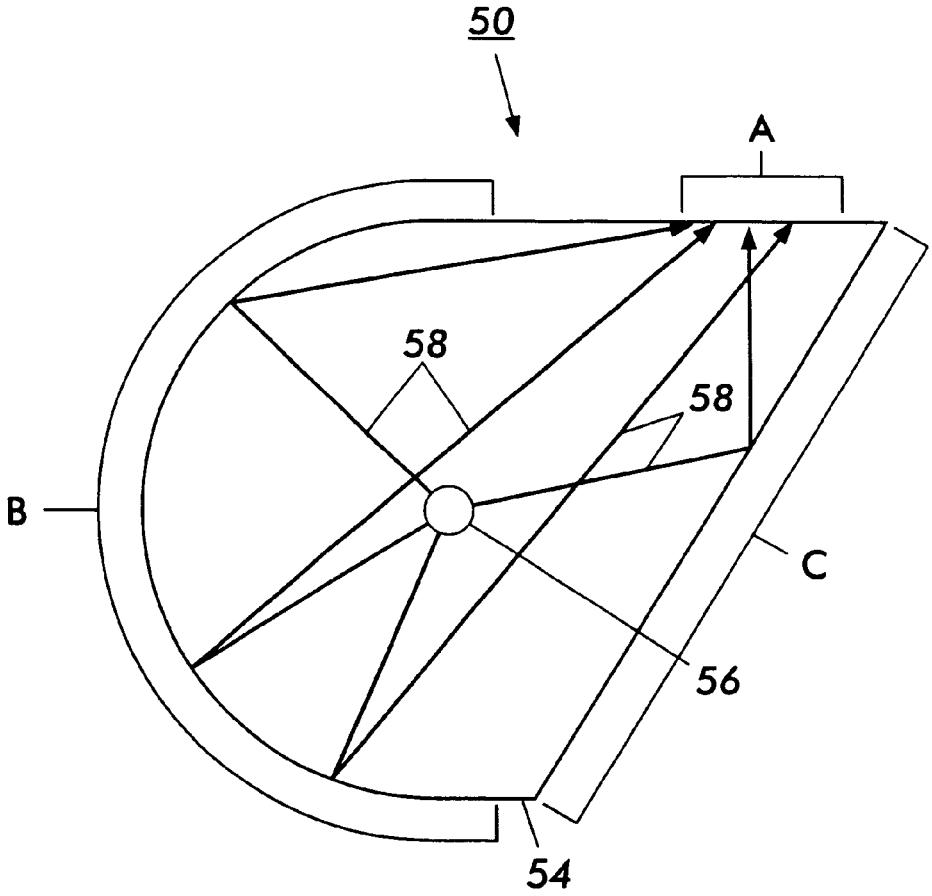
FIG. 2 is a schematic diagram of a dual function radiant heater according to an embodiment of the present invention.

The operation of the dryer 50 will now be described in greater detail with reference to FIG. 2. In FIG. 2, the dual function radiant dryer 50 generally comprises a reflector with a elliptically-shaped cross section 54 surrounding a radiant heat source 56. The heat source 56 is preferably a low color temperature radiant energy source, such as an infra-red bulb or other known heat sources available in the art. Preferably, the heat source 56 is a low color temperature of from about 1000–1300° K.

In one exemplary embodiment of the active dryer system, the heat source 56 is preferably an elongated infrared bulb, which has a filament that extends along the central axis of the bulb. Typically, the bulb will have a length slightly wider than the width of the recording medium being used. Thus, for typical office and home applications where paper widths of up to 8.5 inches are used, the bulb will have a length of about 9 inches. The filament of the bulb should preferably be designed to emit a uniform heat flux from one end of the filament to the other.

An exemplary infra-red bulb suitable for use in the present invention would contain the filament suspended within a bulb housing. Preferably, suitable filaments include iron-aluminum chromium or nickel chromium alloy filaments in a quartz tube housing which forms the bulb. These are relatively simple wire wound filament construction and can be open to the atmosphere. Alternatively, the filament can be suspended in a gas-filled tube, such as in a quartz halogen tube, or in the case of tungsten filament application supported in an evacuated tube, which forms the bulb housing. These and other bulb designs are generally known in the art and can readily be incorporated into the radiant dryer of the present invention.

Furthermore, although it is preferred that the heat source emit a uniform heat flux from the entire source, i.e., in the case of a bulb from all angles of the bulb around its central axis, a reflective coating can be applied to a portion of the bulb. That is, for example, in the case the quartz tube bulb described above, a reflective coating can be applied to a portion of the bulb to provide a non-uniform heat flux from the bulb. In this case, the reflectiveness of the dryer reflector can be altered accordingly, so as to provide the desired preheat and primary heating functions. Thus, the use of a reflective coating on a portion of the bulb provides additional design latitude in designing specific shapes of the dryer reflector.

The dryer 50 generally can be described as having three different zones, labeled A, B and C in FIG. 2. Zone A generally corresponds to the print zone 38 shown in FIG. 1, or to a portion of the print path within or subsequent to the print zone 38, and can either be coextensive with the print zone 38, or can extend on either side of the print zone to provide for pre- or post-printing drying, as desired. In this zone A, the reflector wall 54 of the dryer 50 receives and absorbs a majority of the energy generated by the heat source 56. In this manner, the primary drying function of the dryer is focused into the zone A to provide primary active drying of the recording medium 16 located in or subsequent to the print zone 38. In this zone A, the reflector 54 is subjected to an appropriate surface treatment to provide a low reflectivity (high absorptivity) of the reflector 54. Preferably, in this zone A, the reflectivity of the reflector 54 is from about 0.0 to about 0.25, preferably from about 0.0 to about 0.1, and more preferably from about 0.05 to about 0.1.

Figure 3:
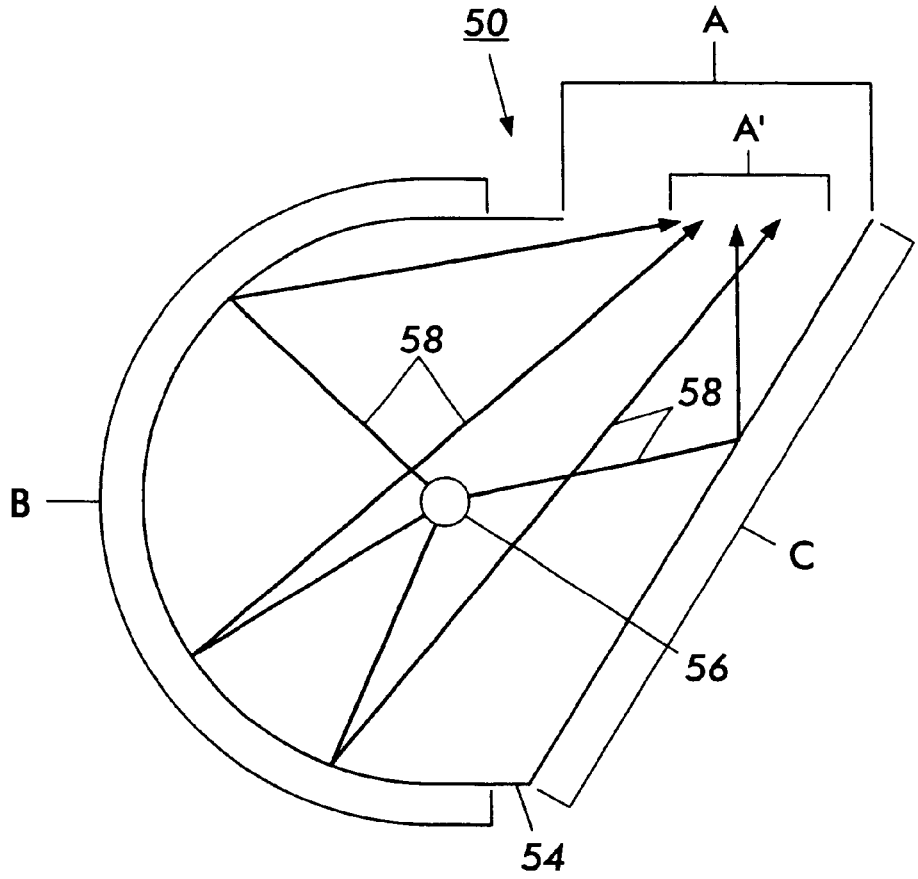
FIG. 3 is a schematic diagram of a dual function radiant heater according to another embodiment of the present invention.

Alternatively, in other exemplary embodiments of the active dryer system, the reflector 54 can be formed as shown in FIG. 3, wherein the zone A is an opening in the reflector 54. In this exemplary embodiment, the opening forming zone A is preferably wider than the print zone 38, which is shown in FIG. 3 as zone A'. In this embodiment, the reflector is shaped such that a higher energy output is realized in the portion of zone A corresponding to the print zone 38 or zone A', with a lower energy output in the portions of zone A located adjacent to the print zone 38. Alternatively, the higher energy output can be focused on an area overlapping with or subsequent to the print zone 38, if active drying outside of the print zone 38 is desired.

Zone B of the dryer 50 generally corresponds to the chute area 28 shown in FIG. 1, and can be coextensive with the chute 28, can be shorter than the chute 28 on either or both sides of the chute 28, or can extend on either side of the chute 28. In this zone B, the reflector 54 is subjected to an appropriate surface treatment to maintain a high reflectivity of the reflector 54. Preferably, in this zone B, the reflectivity of the reflector 54 is from about 0.8 to about 0.97, preferably from about 0.85 to about 0.97, and more preferably from about 0.90 to about 0.95.

Accordingly, although most of the energy impacting on the inner wall of the reflector 54 in zone B is reflected toward the zone A, a portion of the impacting energy is absorbed by the inner wall of the reflector 54 in zone B. This absorbed energy is transferred through the inner guide member 32 to preheat the recording medium 16. Alternatively, the inner guide member 32 can be formed by the outer wall of the reflector 54 of the dryer 50, rather than as a separate component. In this embodiment of the active dryer system, the heat absorbed by the inner wall of the reflector 54 can be directly transferred to the recording medium 16 to preheat the recording medium 16.

Generally, in the exemplary embodiments of the active dryer system, the temperature in the preheat zone B is maintained at a temperature lower than the temperature in the primary heating zone A. Thus, for example, the temperatures and energy densities are suitably maintained at levels so as to provide paper temperatures in the preheat region of generally from about 100 to about 150° F. and in the primary drying region of generally from about 175 to about 250° F. As such, a lower energy density is transferred to the recording medium in the preheat zone B than is transferred to the recording medium in the primary heat zone A. Generally, energy densities absorbed by the reflector, and transferred to the recording medium, in the preheat zone B are from about 1 to about 5 $W/in^2$, preferably from about 2 to about 4 $W/in^2$, and more preferably from about 2 to about 3 $W/in^2$. Generally, energy densities transferred to the recording medium in the primary heat zone A (i.e., in or subsequent to the print zone) are from about 4 to about 10 $W/in^2$, preferably from about 5 to about 8 $W/in^2$, and more preferably from about 5 to about 6 $W/in^2$.

Finally, the zone C of the reflector 54 is generally a flat reflector located at 45° to the major axis of the elliptical cylinder. The purpose of the zone C is to direct substantially all of the impacting energy to the zone A for heating the recording medium 16. Thus, in this zone C, the reflector 54 is subjected to an appropriate surface treatment to maintain a high reflectivity of the reflector 54. Preferably, in this zone C, the reflectivity of the reflector 54 is from about 0.8 to about 1.0, preferably from about 0.85 to about 1.0, and more preferably above about 0.90

Other areas of the reflector, that is, other than the particular areas discussed above, are also preferably subjected to an appropriate surface treatment to maintain a high reflectivity of the reflector 54. Preferably, in these areas, the reflectivity of the reflector 54 is from about 0.8 to about 1.0, preferably from about 0.85 to about 1.0, and more preferably above about 0.90.

In the exemplary embodiments of the active dryer system described above, the reflector is preferably made of a heat conductive material, which can selectively be made reflective or conductive based on varying the surface treatment. In particular, the reflector is made of aluminum, but other materials such as stainless steel can also be used. Preferably, the reflector housing is made of a material that is thin enough to permit efficient conduction of absorbed heat, but thick enough to provide a rigid surface where rigidity is required.

The reflector surface, and particularly the inside surface, can be selectively surface treated to provide a desired range of reflectivity. For example, where an aluminum reflector is used, reflectivity of the surface can be increased by applying a high polish to the surface. Alternatively, secondary materials can be applied to the surface to alter its reflectivity and prevent environmental oxidation that can change refelctivity over time. For example, a thin layer of a highly reflective material, such as gold, silver, or other thin films, can be applied to the reflector surface.

In the exemplary embodiments of the active dryer system described above, the energy densities supplied by the heat source to the respective preheat and primary heating areas can be selectively changed and adjusted by altering the surface reflectivity of portions of the reflector surface facing the heat source. Thus, for example, a portion of the reflector surface can be painted or otherwise treated to decrease its reflectivity (i.e., increase its absorptivity). Similarly, regions of the reflector surface can also be painted or treated to alter the reflectivity, to alter the energy density profile in respective preheat and primary heating areas to provide non-uniform profiles. Such changes will be apparent to one skilled in the art based on the instant disclosure.

In the above discussion, the reflector design has been discussed with reference to a particular reflector design as demonstrated in the attached Figures. That is, the reflector has been described with respect to a particular embodiment where the cross section is a partial ellipse closed by a line intersecting the ellipse at an angle of from about 30 to about 60° to the major axis of the ellipse. Preferably the partial ellipse is closed by a line intersecting the ellipse at an angle of from about 40 to about 50° to the major axis of the ellipse, and more preferably about 45° to the major axis of the ellipse. However, it will be apparent to those skilled in the art based on the present disclosure that other reflector shapes can be used in the present invention. For example, with minimal design changes to the printing machine, a dual function radiant dryer could be provided where the reflector takes the shape of a parabola, where the heat source is located at the focus of the parabola, the primary heat zone is located at the "mouth" or open end of the parabola, and the preheat zone is located along a selected side of the parabola. Other shapes could also be selected based on appropriate design considerations.

Furthermore, in such standard geometric shapes, it is preferred that the dryer reflector design be such that there is at least one focal point within the reflector. In this case, the heat source can be located at the focal point, so that the majority of the energy given off by the heat source can be focused at a single area, such as the print zone. However, other reflector designs, not having a particular focal point, can also be used so long as a sufficient amount of energy can be concentrated at the print zone, and a lesser amount of energy can be provided to a secondary preheat area.

Furthermore, a particular advantage of the active dryer system, and especially in the exemplary embodiments having a geometric focal point within the reflector, is that both heating functions can be accomplished with a single heat source. However, as will be readily apparent, multiple heat sources can be incorporated into the reflector if desired.

Figure 5:
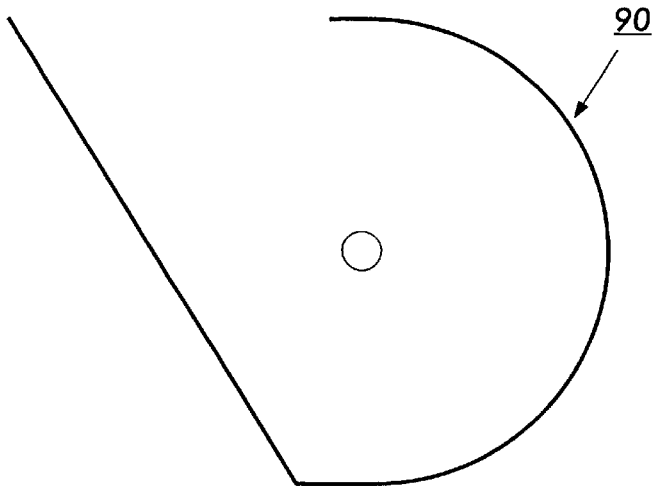
FIG. 5 is a schematic diagram of a dual function radiant heater providing the irradiance graph of FIG. 4.

The irradiance profile of one exemplary radiant heater, as shown in FIG. 5, is analyzed using the analytical reflector design tool. The radiant dryer 90 forms an ellipse, having a major axis of 43.2 mm and a minor axis of 21.5 mm, giving an eccentricity of 0.867. The infra-red source is located at the right focus of the ellipse, and a flat reflector is tilted to 45° to the major axis and intersects the major axis at 25.5 mm in front of the left focus of the ellipse. The energy distribution is adjusted to give a uniform distribution over a width of 12 mm, which is slightly wider than an exemplary print swath of a printhead.

Figure 4:
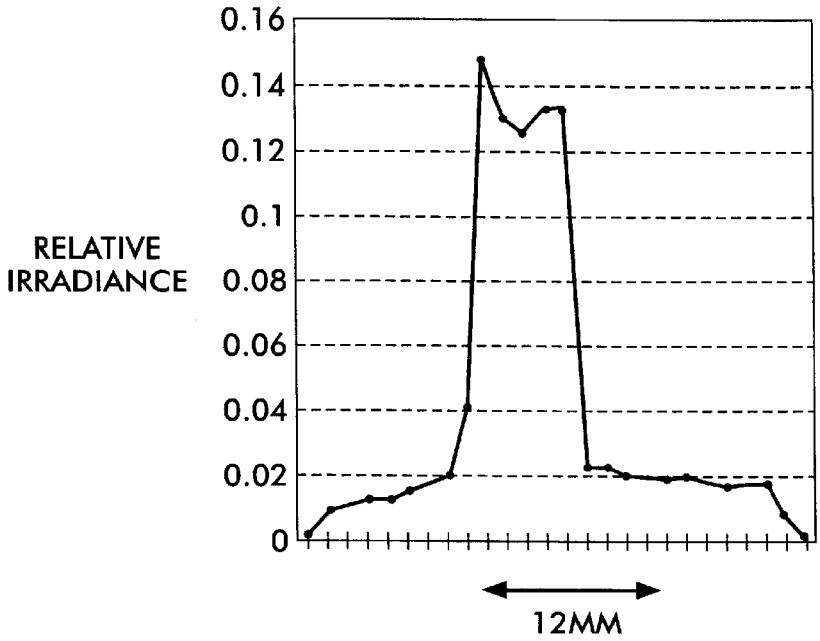
FIG. 4 is a graph showing relative irradiance versus relative position of a dual function radiant heater according to an embodiment of the present invention.

FIG. 4 shows the distribution of the irradiance profile versus the relative position in the opening of the radiant dryer 90 shown in FIG. 5. FIG. 4 shows that for the radiant dryer 90, an almost uniform distribution of irradiance is achieved over about the 12 mm width, with substantially no irradiance outside of the 12 mm width.

One skilled in the art will recognize that the various aspects of the dual function radiant dryer discussed above may be selected and adjusted as necessary to achieve specific results for a particular printer application.

The foregoing exemplary embodiments are intended to illustrate and not limit this invention. It will be apparent that various modifications can be made without departing from the spirit and scope of the invention.

What is claimed is:

1. A printing machine for printing on a recording medium moving along a path through a print zone, comprising:

a printhead adapted to deposit liquid ink on the recording medium in the print zone; and a radiant dryer, disposed adjacently to the path, that heats the recording medium, comprising:

a heat source, and a reflector including a first portion defining a first heat region positioned in said path prior to said print zone and a second portion defining a second heat region positioned in or subsequent to the print zone, wherein said heat source generates heat resulting in the first portion having a first temperature and second portion having a second temperature greater than said first temperature.

2. The printing machine of claim 1, wherein the first heat region preheats the recording medium and the second heat region heats the recording medium in or subsequent to the print zone.

3. The printing machine of claim 1, wherein the reflector is a non-linear reflector having at least one focal point spaced from the reflector, and the heat source is disposed at one of the focal point.

4. The printing machine of claim 3, wherein an inner surface of the first portion of the reflector facing the heat source has a reflectivity of from about 0.8 to about 0.97.

5. The printing machine of claim 3, wherein an inner surface of the first portion of the reflector facing the heat source has a reflectivity of from about 0.85 to about 0.97.

6. The printing machine of claim 3, wherein an inner surface of the first portion of the reflector facing the heat source has a reflectivity of from about 0.9 to about 0.95.

7. The printing machine of claim 3, wherein an inner surface of the first portion of the reflector facing the heat source has a reflectivity of from about 0.8 to about 0.97 and an inner surface of the second portion of the reflector facing the heat source has a reflectivity below about 0.25.

8. The printing machine of claim 3, wherein the reflector is formed from a material comprising aluminum.

9. The printing machine of claim 3, wherein the reflector has a cross-sectional shape of a partial ellipse closed by a line intersecting the ellipse at an angle of 30 to 60° to a major axis of the ellipse.

10. The printing machine of claim 3, wherein, in the first heat region, the recording medium contacts an outer surface of the first portion of the reflector disposed away from the heat source.

11. The printing machine of claim 3, wherein, in the second heat region, the recording medium is directly exposed to the heat source through an aperture in the second portion of the reflector.

12. The printing machine of claim 3, wherein the heat source is a single heat source.

13. The printing machine of claim 3, wherein a power density delivered to the recording medium in the first heat region by the radiant dryer is from about 2 to about 4 $W/in^2$.

14. The printing machine of claim 3, wherein a power density delivered to the recording medium in the second heat region by the radiant dryer is from about 5 to about 8 $W/in^2$.

15. The printing machine of claim 3, wherein the reflector provides a uniform power density profile in the second heat region.

16. The printing machine of claim 3, wherein the reflector provides a non-uniform power density profile in the second heat region.

17. The printing machine of claim 16, wherein a portion of an inner surface of the reflector is painted or treated to provide the non-uniform power density profile around the circumference of the reflector.

18. A method for printing an image using the printing machine of claim 1, comprising:

feeding a recording medium into the path preheating the recording medium in the first heat region, depositing ink on the recording medium in the print zone using the printhead to form a printed image, and heating the recording medium in the second heat region to dry the printed image.

19. A printing machine for printing on a recording medium moving along a path through a print zone, comprising:

printing means for depositing ink on the recording medium in the print zone; and dryer means, disposed adjacently to the path, for heating the recording medium, comprising:

heating means, and reflector means including:

a first portion defining a first heat region for preheating the recording medium at a position in the path prior to the print zone, and a second portion defining a second heat region for heating the recording medium in or subsequent to the print zone, wherein the heat source generates heat energy resulting in a first portion having a first temperature and the second portion having a second temperature greater than the first temperature.

20. A radiant dryer comprising:

a heat source, and a reflector, including:

a first portion defining a first heat region, and a second portion defining a second heat region, wherein the heat source generates heat energy resulting in a first portion having a first temperature and the second portion having a second temperature greater than the first temperature.

* * * * *